US008245995B2

(12) United States Patent
Yamamoto

(10) Patent No.: US 8,245,995 B2
(45) Date of Patent: Aug. 21, 2012

(54) WALL-MOUNTED DEVICE AND TIMEPIECE WITH THE SAME

(75) Inventor: Masafumi Yamamoto, Tokyo (JP)

(73) Assignee: Seiko Clock Inc., Tokyo (JP)

( * ) Notice: Subject to any disclaimer, the term of this patent is extended or adjusted under 35 U.S.C. 154(b) by 683 days.

(21) Appl. No.: 12/297,700

(22) PCT Filed: Apr. 18, 2007

(86) PCT No.: PCT/JP2007/058448

§ 371 (c)(1),
(2), (4) Date: Oct. 20, 2008

(87) PCT Pub. No.: WO2007/123158

PCT Pub. Date: Nov. 1, 2007

(65) Prior Publication Data

US 2009/0090829 A1 Apr. 9, 2009

(30) Foreign Application Priority Data

Apr. 18, 2006 (JP) ..... 2006-114351

(51) Int. Cl.
*A47B 23/04* (2006.01)

(52) U.S. Cl. ..... 248/447.1; 248/442; 248/497; 248/115; 358/316

(58) Field of Classification Search ..... 248/467, 248/442, 447.1, 475.1, 497, 114, 115, 221.11, 248/222.11; 368/346; 40/757
See application file for complete search history.

(56) References Cited

U.S. PATENT DOCUMENTS 3,222,018 A * 12/1965 Masters ..... 248/475.1
3,861,631 A * 1/1975 Shorin ..... 248/546
4,113,217 A * 9/1978 O'Connell ..... 248/222.11
4,821,992 A * 4/1989 Johnson ..... 248/493
5,330,149 A * 7/1994 Haan et al. ..... 248/549
(Continued)

FOREIGN PATENT DOCUMENTS

JP 09-257013 9/1997

OTHER PUBLICATIONS

JP Office Action for Japanese Patent Application No. 2006-114351 drafted Sep. 21, 2010.

*Primary Examiner* — Bradley Duckworth
(74) *Attorney, Agent, or Firm* — Howard & Howard Attorneys PLLC

(57) ABSTRACT

A wall-mounted device (1) which ensures easy confirmation of the mounting of a to-be-mounted-on-wall object on a wall surface or the like, and can prevent the to-be-mounted-on-wall object from falling off, and a timepiece having the device are provided. First, an attachment fitting (30) is fixed to the wall surface or the like by screws. Then, a hook part (30*a*) of the attachment fitting (30) is hooked on a hanging part (13) of the wall-mounted device (1) while deforming an elastic plate member (10) inward. When deformation of the elastic plate member (10) is released, vibration occurs together with generation of a light impact sound at the time the elastic plate member returns from the deformed state to the original state. With a first bent part (10*a*) of the elastic plate member (10) being in abutment with the hook part (30*a*) of the attachment fitting (30), the to-be-mounted-on-wall object is mounted on the wall surface or the like.

10 Claims, 9 Drawing Sheets

U.S. PATENT DOCUMENTS 5,439,305 A * 8/1995 Santo ..... 403/76
5,850,996 A * 12/1998 Liang ..... 248/221.11
5,878,988 A * 3/1999 Rakower ..... 248/497
6,865,836 B2 * 3/2005 Sachs-Lavery ..... 40/741
7,004,436 B2 * 2/2006 Knapp ..... 248/220.22
7,658,362 B2 * 2/2010 El Haje ..... 248/475.1

* cited by examiner (a)

(b)

(c)

(a)

(b)

(c)

WALL-MOUNTED DEVICE AND TIMEPIECE WITH THE SAME

TECHNICAL FIELD

The present invention relates to a wall-mounted device for mounting a to-be-mounted-on-wall object, such as a wall-mounted timepiece or a frame, on a wall surface or a pillar surface, and a timepiece having the device.

BACKGROUND ART

In case of mounting a to-be-mounted-on-wall object on a wall surface or the like, a hook hole provided in the to-be-mounted-on-wall object is often hooked on a nail, a screw, a fixture or the like fixed on a wall surface or so (e.g., Patent Literature 1).

Patent Literature 1: Unexamined Japanese Utility Model Application KOKAI Publication No. S57-194087

DISCLOSURE OF INVENTION

Problems to be Solved by the Invention

The aforementioned method of mounting a to-be-mounted-on-wall object involves a simple structure of hooking a hook hole provided in the casing of the to-be-mounted-on-wall object onto the hook part or the like of a fixture from above. When the to-be-mounted-on-wall object is lifted up, or vibration or shock caused by an earthquake or the like acts in a direction of pushing the to-be-mounted-on-wall object upward, therefore, the to-be-mounted-on-wall object may come off the hook part or the like of the fixture and fall off.

In addition, the aforementioned method of mounting a to-be-mounted-on-wall object makes it difficult to check if the hook part or the like of the fixture is surely hooked in the hook hole of the to-be-mounted-on-wall object.

The present invention has been made in view of the above problems, and it is an object of the invention to provide a wall-mounted device which ensures easy confirmation of the mounting of a to-be-mounted-on-wall object on a wall surface or the like, and can prevent the to-be-mounted-on-wall object from falling off, and a timepiece having the device.

Means for Solving the Problem

To achieve the object, according to the present invention, a wall-mounted device for mounting a to-be-mounted-on-wall object on a wall surface or a pillar surface includes a hanging part which is formed at a back side of the to-be-mounted-on-wall object and on which a fixture is to be hung, a recessed part formed contiguous to the hanging part of the to-be-mounted-on-wall object, and an elastic member which is to be mounted in the recessed part, holds the fixture, and bends when pressed.

The wall-mounted device may further include a fixture having a portion to be fixed to the wall surface or pillar surface, and a portion to be hung on the hanging part.

The elastic member may include a plate member which holds the fixture with in-plane rigidity, and to be bent in the recessed part to expose the hanging part when pressed.

The elastic member may have a first bent part at a position to abut on the fixture.

The fixture may have a hook part which is arranged in abutment with the first bent part.

The elastic member may be formed so as to generate a sound when bent and/or returning from a bent state.

A wall surface constituting the recessed part may be formed tapered toward the hanging part.

The elastic member may have a shape corresponding to a shape of the recessed part.

The elastic member may have a second bent part with an L-shaped cross section, and is bent with the second bent part being a fulcrum when the elastic member is pressed toward out-of-plane direction thereof.

The elastic member may abut on a bottom surface of the recessed part when pressed and bent to a predetermined deformation.

An attaching/detaching member which is attachable and detachable to and from the wall surface or pillar surface facing the back side of the to-be-mounted-on-wall object may be provided at the back side of the to-be-mounted-on-wall object.

To achieve the object, a timepiece according to the present invention has the wall-mounted device.

Effect of the Invention

The present invention can provide a wall-mounted device which ensures easy confirmation of the mounting of a to-be-mounted-on-wall object on a wall surface or the like, and can prevent the to-be-mounted-on-wall object from falling off, and a timepiece having the device.

EXPLANATION OF REFERENCE NUMERALS

Figure 1:
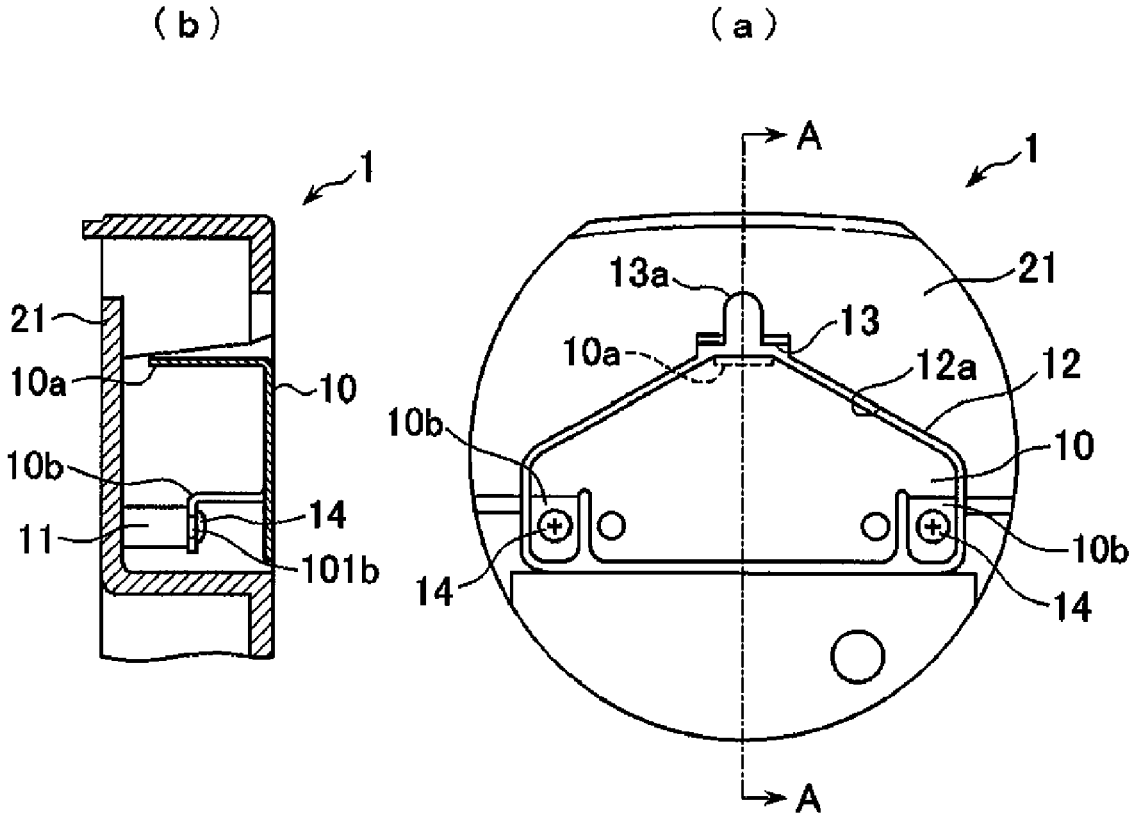
FIG. 1(*a*) is a front view of a wall-mounted device according to an embodiment of the present invention, and FIG. 1(*b*) is a cross-sectional view along line A-A in FIG. 1(*a*) as seen from arrows.

1 wall-mounted device
10 elastic plate member
10*a* first bent part
10*b* second bent part

11 boss part
12 elastic-plate-member hole
12*a* upper wall surface
13 hanging part
13*a* cutaway portion
14 fixing screw
20 wall-mounted timepiece
21 casing
22 surface fastener
30 attachment fitting
30*a* hook part
40 wooden screw

BEST MODE FOR CARRYING OUT THE INVENTION

A wall-mounted device according to an embodiment of the present invention, and a wall-mounted timepiece having the device will be described below with reference to FIG. 1(*a*) to FIG. 4.

Figure 4:
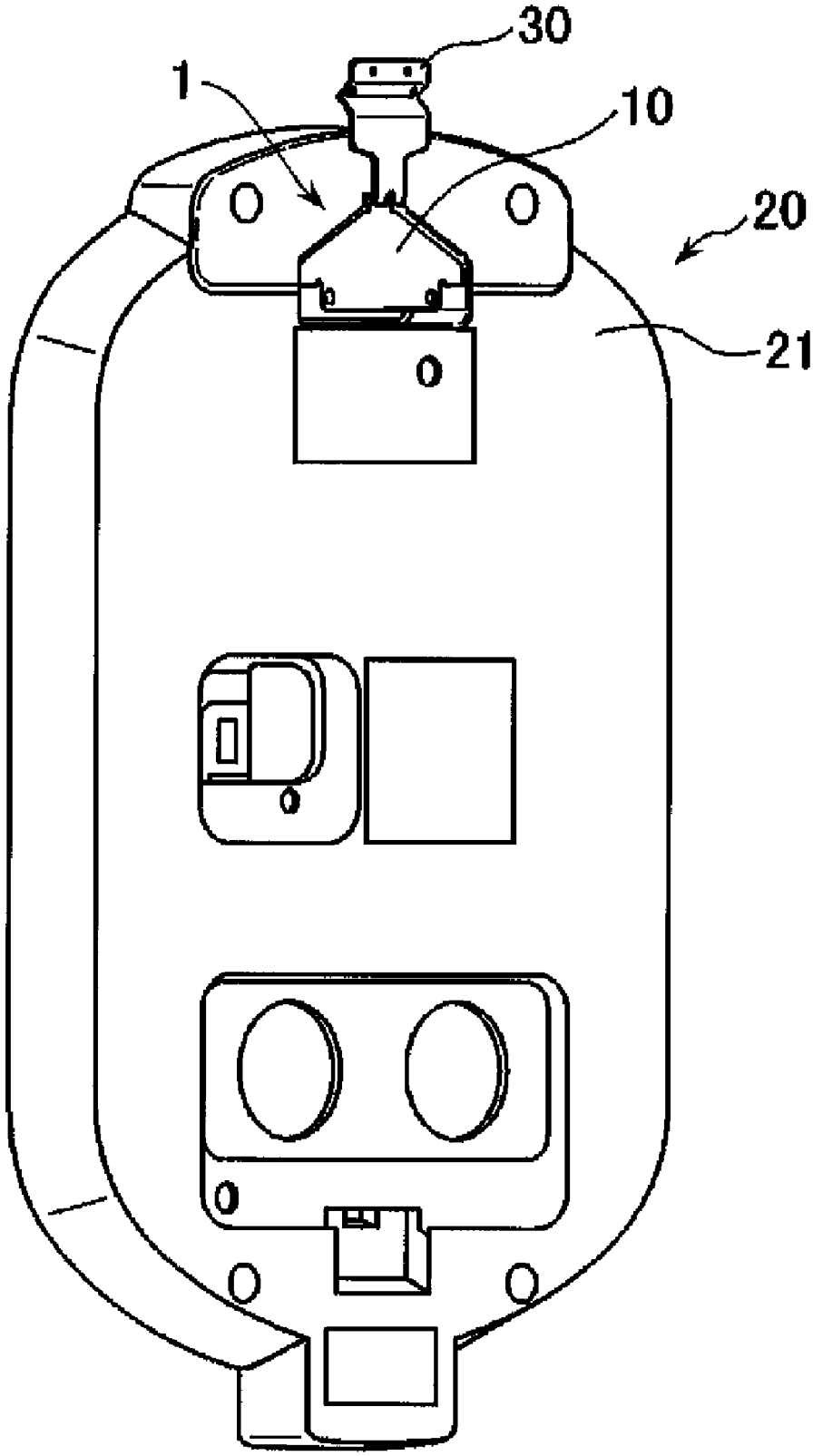
FIG. 4 is a perspective view showing the structure of a wall-mounted timepiece having the wall-mounted device shown in FIGS. 1(*a*) and 1(*b*).

As shown in FIG. 4, a wall-mounted device 1 constitutes a part of a wall-mounted timepiece 20 as an object to be mounted on a wall. The wall-mounted device 1 is for mounting a to-be-mounted-on-wall object on a wall surface or a pillar surface.

As shown in FIGS. 1(*a*) and 1(*b*), the wall-mounted device 1 comprises an elastic plate member 10, two boss parts 11, an elastic-plate-member hole 12, a hanging part 13 and two fixing screws 14.

The elastic plate member 10 is a member for preventing the wall-mounted timepiece 20 from falling off. The elastic plate member 10 can be deformed toward the wall-mounted timepiece 20, as shown by a broken line in FIG. 2(*b*). The elastic plate member 10 is deformed toward the wall-mounted timepiece 20, for example, at the time of mounting and dismounting the wall-mounted timepiece 20 on and from a wall surface or the like. The elastic plate member 10 is made of a plate-like elastic member, such as a stainless thin plate spring material.

The elastic plate member 10 is deformed so that a hook part 30*a* of an attachment fitting 30 to be described later (see FIGS. 2(*a*) and 2(*b*)) is guided to the hanging part 13, thereby opening the elastic-plate-member hole 12. When the hook part 30*a* is placed at the hanging part 13, the elastic plate member 10 is returned to the original state from the deformed state. At this time, vibration occurs together with generation of a light impact sound.

Figure 5:
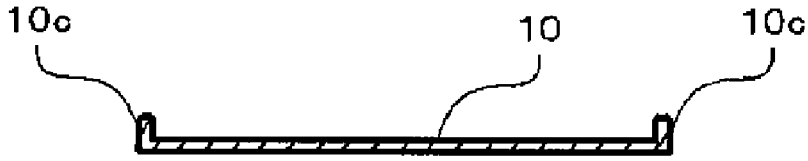
FIG. 5(*a*) is a horizontal cross-sectional view of an elastic plate member having bent parts provided at both side ends, FIG. 5(*b*) is a horizontal cross-sectional view of an elastic plate member having an angled cross section, and FIG. 5(*c*) is a cross-sectional view showing a portion of abutment of an elastic plate member and an attachment fitting shown in FIGS. 1(*a*) and 1(*b*).
Figure 5:
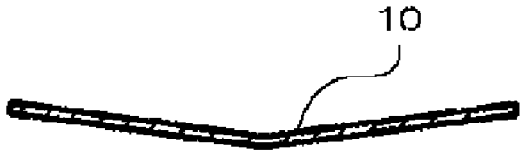
Figure 5:
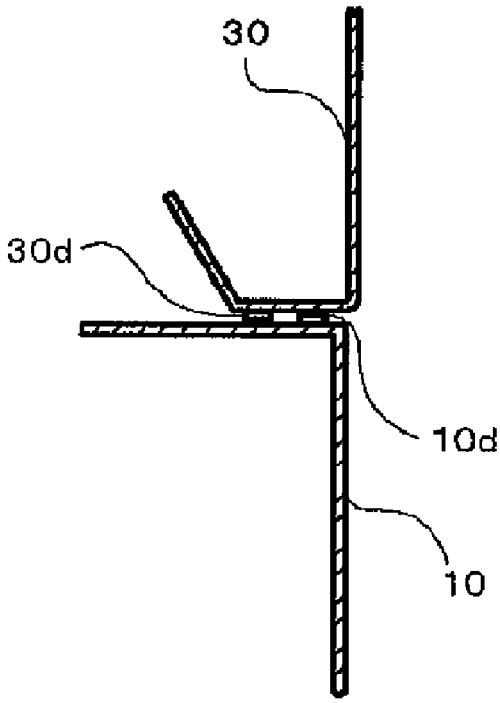

The elastic plate member 10 is formed in consideration of the material, the thickness, the shape and so forth so as to cause vibration and sound when returning. For example, the elastic plate member 10 has a bent part 10*c* formed at both side ends entirely or partly, as shown in a horizontal cross section in FIG. 5(*a*), or has the entire horizontal cross section or a part thereof angled as shown in FIG. 5(*b*). When pressed and deformed, therefore, a part of the plate member can be warped while keeping the elastic state. When the elastic plate member 10 is returned to the original state from the deformed state, the warping returns to the original state, vibration occurs together with generation of a light impact sound. As shown in FIG. 5(*c*) showing a portion of abutment of the elastic plate member 10 and the attachment fitting 30, projections 10*d*, 30*d* are formed at parts of the elastic plate member 10 and the attachment fitting 30. At the time the elastic plate member 10 returns to the original state from the deformed state, therefore, hooking of the projections is released, and at the same time, vibration occurs together with generation of a light impact sound.

The elastic plate member 10 has a first bent part 10*a* formed at an upper portion and a pair of second bent parts 10*b* formed at both lower ends.

The first bent part 10*a* is bent from the main body at substantially 90 degrees, and extends horizontally in a normal state. The first bent part 10*a* is disposed at a position to face and abut on the hook part 30*a* of the attachment fitting 30. With the abutment with the hook part 30*a* maintained, the first bent part 10*a* prevents the attachment fitting 30 from coming off the hanging part 13. The end of the first bent part 10*a* abuts on a casing 21 when the elastic plate member 10 is pressed to a predetermined amount of deformation. This prevents the elastic plate member 10 from being deformed by a predetermined amount of deformation or more to be plastically deformed.

The pair of second bent parts 10*b* serve to fix the elastic plate member 10 to the casing 21 of the wall-mounted timepiece 20. The pair of second bent parts 10*b* are constituted by a bent part having an L-shaped cross section. Through holes 101*b* for insertion of the fixing screws 14 are formed in the pair of second bent parts 10*b*.

The fixing screw 14 is put through the through hole 101*b* of the second bent part 10*b*, and is screwed into the boss part 11 formed at the casing 21. Accordingly, the elastic plate member 10 is fixed inside the elastic-plate-member hole 12 of the casing 21.

The two boss parts 11 protrude from the front side of the casing 21 of the wall-mounted timepiece 20 as a to-be-mounted-on-wall object to the rear side. A female thread in which the fixing screw 14 is to be screwed is formed in the boss part 11 provided upright at the casing 21. The second bent parts 10*b* of the elastic plate member 10 are fixed to the two boss parts 11 by screwing of the fixing screws 14 into the female threads, and the two boss parts 11 support the elastic plate member 10.

The elastic-plate-member hole 12 constitutes a recessed part formed on the rear side of the casing 21 of the wall-mounted timepiece 20. As shown in FIG. 2(*b*), the elastic-plate-member hole 12 is formed to have a sufficient depth, so that the mounting and dismounting of the wall-mounted timepiece 20 can be achieved by deforming the elastic plate member 10.

Figure 6:
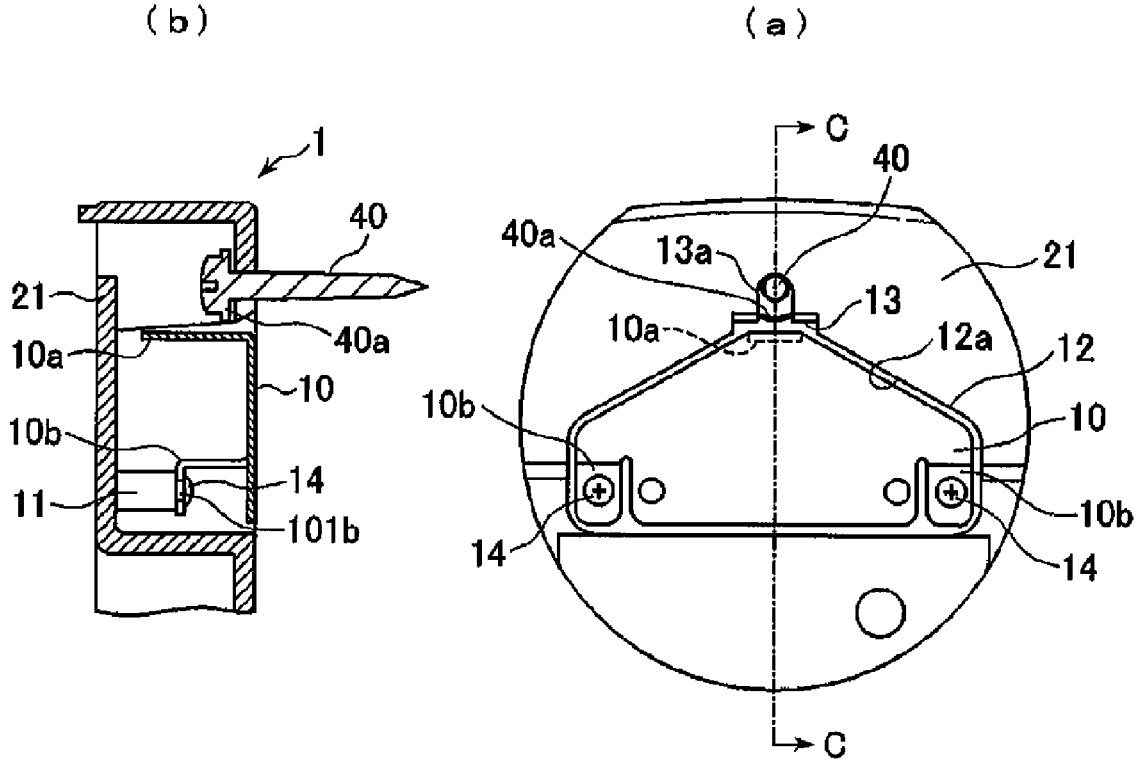
FIG. 6(*a*) is a front view showing a wooden screw fitted in the wall-mounted device shown in FIGS. 1(*a*) and 1(*b*), and FIG. 6(*b*) is a cross-sectional view along line C-C in FIG. 6(*a*) as seen from arrows.
Figure 7:
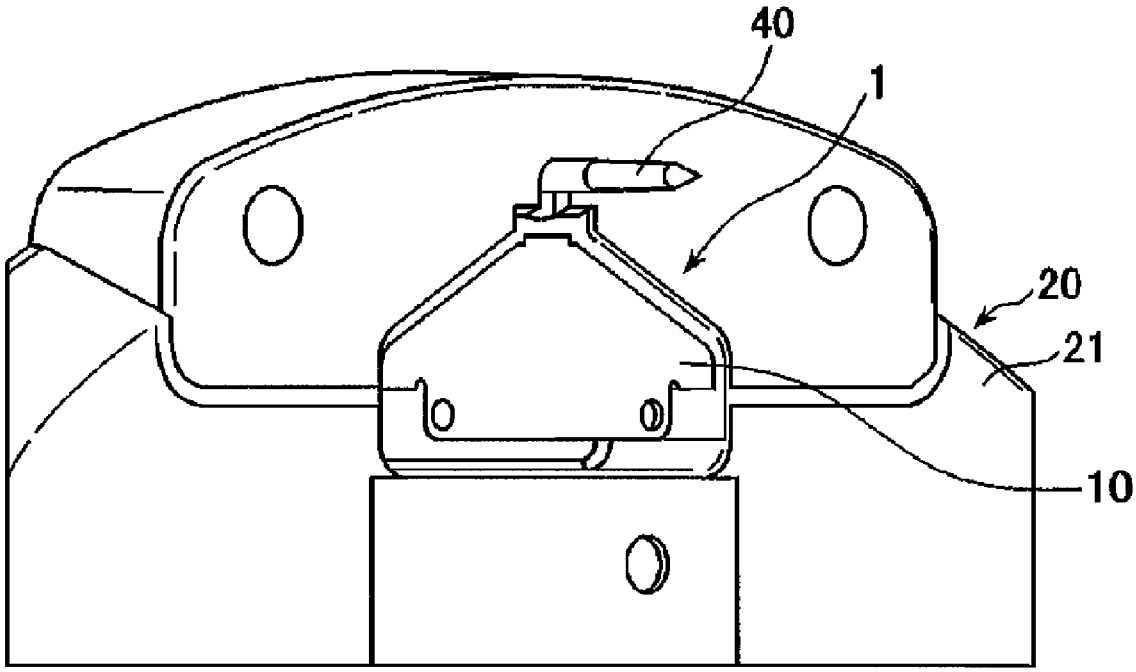
FIG. 7 is a perspective view showing the structure of the wall-mounted device with the wooden screw shown in FIGS. 6(*a*), 6(*b*) fitted therein.

The hanging part 13 is for hooking the hook part 30*a* of the attachment fitting 30 (see FIGS. 2(*a*) and 2(*b*)), and a cutaway portion 13*a* formed in the hanging part 13 is for the case of using a wooden screw 40 to be described later (see FIGS. 6(*a*) and 6(*b*), and FIG. 7).

The hanging part 13 is formed contiguous to the elastic-plate-member hole 12. An upper wall surface 12*a* constituting the elastic-plate-member hole 12 is formed in such a way that the width of the elastic-plate-member hole 12 gradually becomes narrower toward the hanging part 13. Therefore, the hook part 30*a* of the attachment fitting 30 can be guided to the hanging part 13 while abutting on the upper wall surface 12*a*.

In case of attaching the wall-mounted timepiece 20 to the attachment fitting 30, the hanging part 13 is positioned top-side bottom, so that its position is hard to be confirmed. As the elastic plate member 10 is pressed and deformed inward, however, the upper wall surface 12*a* of the elastic-plate-member hole 12 appears to guide the hook part 30*a* to the hanging part 13.

Figure 2:
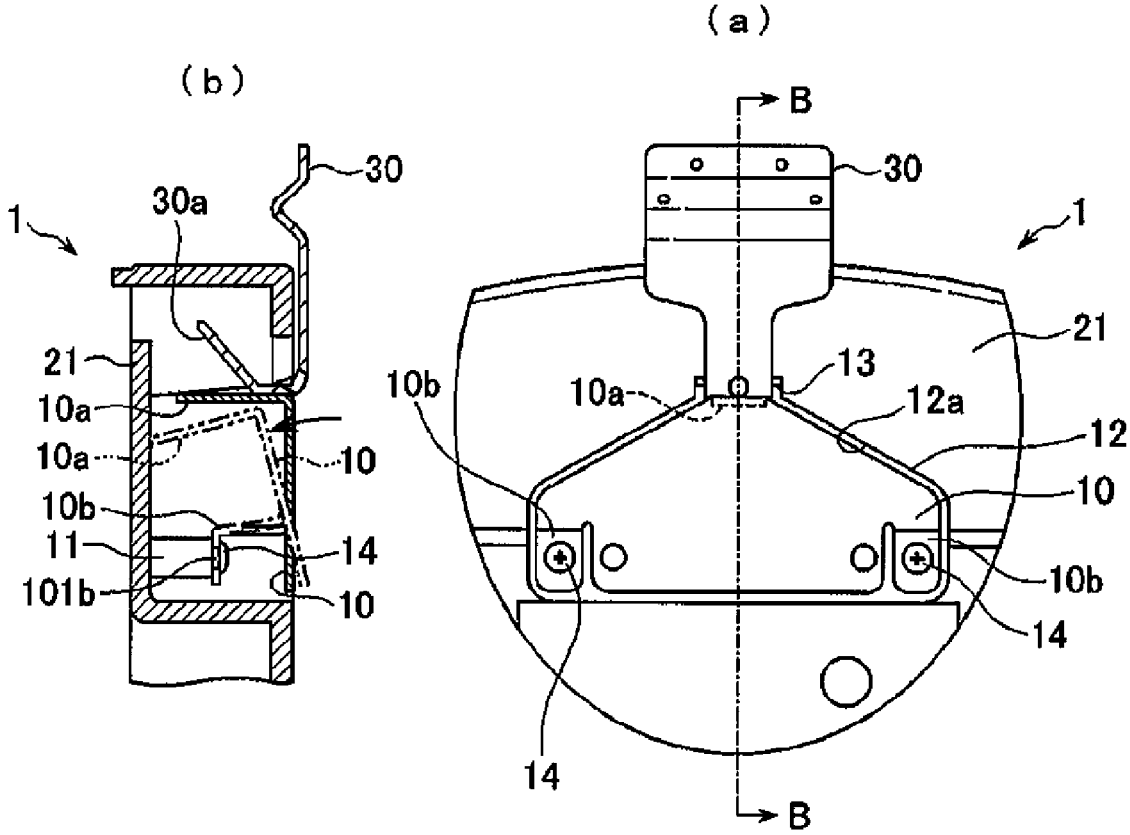
FIG. 2(*a*) is a front view showing the wall-mounted device hooked on an attachment fitting, and FIG. 2(*b*) is a cross-sectional view along line B-B in FIG. 2(*a*) as seen from arrows.
Figure 3:
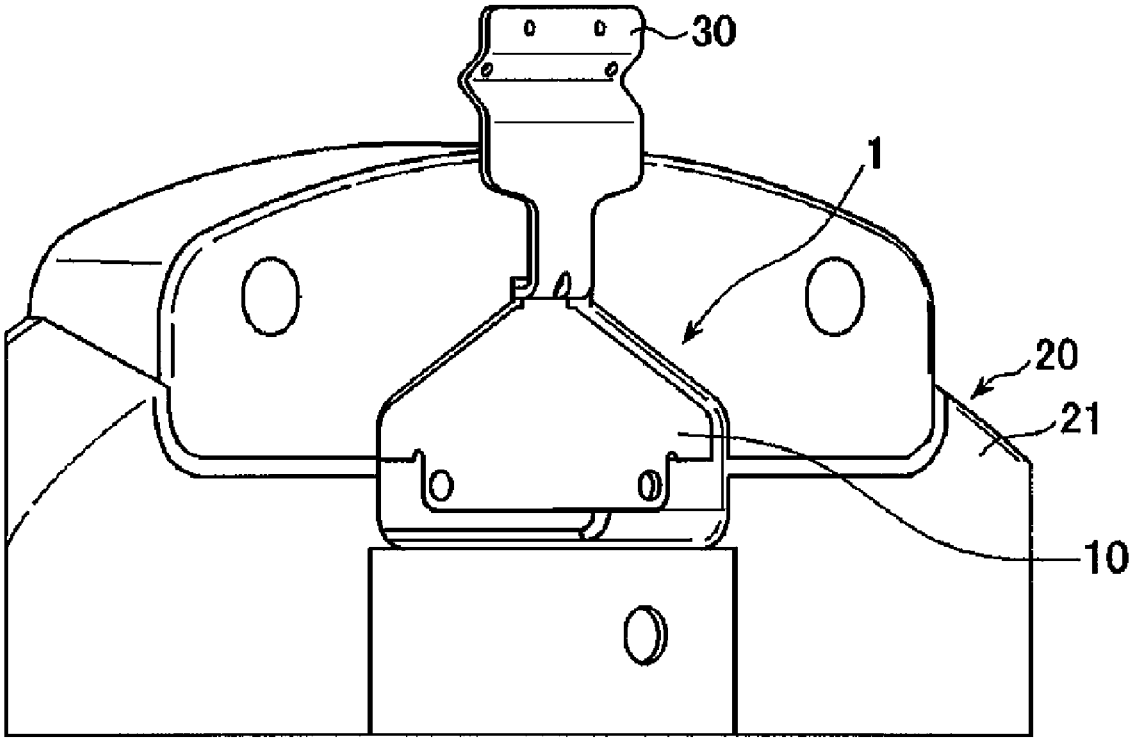
FIG. 3 is a perspective view showing the structure of the wall-mounted device hooked on the attachment fitting shown in FIGS. 2(*a*) and 2(*b*).

To mount the wall-mounted timepiece 20 on a wall surface or a pillar surface using the wall-mounted device 1, first, the attachment fitting 30 shown in FIGS. 2(*a*) and 2(*b*) is fixed to the wall surface or the like by screws.

Then, the hook part 30*a* of the attachment fitting 30 is hooked on the hanging part 13 of the wall-mounted device 1 while the elastic plate member 10 is deformed inward as shown in FIG. 2(*b*). Releasing the deformation of the elastic plate member 10 causes vibration together with generation of a light impact sound when the elastic plate member 10 is returned to the original state from the deformed state. With the first bent part 10*a* of the elastic plate member 10 being in abutment with the hook part 30*a* of the attachment fitting 30, the wall-mounted timepiece 20 is mounted on the wall surface or the like.

To dismount the wall-mounted timepiece 20 from the wall surface or the like, the elastic plate member 10 is deformed inward first. This creates space enough to detach the hook part 30*a* of the attachment fitting 30 from the hanging part 13. Then, the casing 21 of the wall-mounted timepiece 20 should be lifted upward while pressing the elastic plate member 10.

Suppose that vibration or impact originated from an earthquake or so acts on the wall-mounted device according to the embodiment in a direction of pushing the wall-mounted timepiece 20 upward. Even in such a case, the first bent part 10*a* of the elastic plate member 10 holds the hook part 30*a* of the attachment fitting 30, thereby preventing the hook part 30*a* from coming off the hanging part 13. This is because when force acts in the direction of pushing the wall-mounted timepiece 20 upward, the elastic plate member 10 receives the force in the in-plane direction in which the elastic plate member 10 formed has substantial rigidity.

In the wall-mounted device according to the embodiment, the hook part 30*a* of the attachment fitting 30 is guided to an adequate position, and vibration occurs together with generation of a light impact sound when the elastic plate member 10 is returned to the original state from the deformed state. This makes it possible to easily confirm the adequate mounting of the wall-mounted timepiece 20 on a wall surface or the like, and thus prevent the wall-mounted timepiece 20 from falling off due to inadequate mounting.

Further, in the wall-mounted device according to the embodiment, the wall-mounted timepiece 20 can be dismounted easily by pressing the elastic plate member 10 with a finger to lift up the casing 21 of the wall-mounted timepiece 20. On the other hand, the dismounting scheme, which is not easily surmised, can serve to prevent theft or so of the wall-mounted timepiece 20.

In addition, in the wall-mounted device according to the embodiment, a stainless plate spring material or the like is used for the elastic plate member 10. This can realize a low-cost and highly reliable structure.

In the wall-mounted device according to the embodiment, the boss part 11 has only to be added without changing the existing shape of the elastic-plate-member hole 12. In addition, the existing attachment fitting 30 or the like can be used. This eliminates the need to use a fitting or a screw which has a special shape and structure for hooking, and can thus suppress the cost.

It is possible to easily confirm the adequate mounting of the wall-mounted timepiece according to the embodiment on a wall surface or the like. This can prevent inadequate-mounting originated fall-off of the wall-mounted timepiece. Further, because the dismounting scheme is not easily surmised, theft of the wall-mounted timepiece can be prevented. As a result, a low-cost and highly reliable structure can be realized.

The present invention is not limited to the foregoing embodiment, and can be modified and applied in various forms. While the foregoing description of the embodiment has been given of the example of using the attachment fitting 30, for example, a wooden screw 40 may be used instead of the attachment fitting 30 as shown in FIGS. 6(*a*) and (*b*) and FIG. 7.

While the foregoing description of the embodiment has been given of the example where a to-be-mounted-on-wall object is the wall-mounted timepiece 20, the to-be-mounted-on-wall object may be a frame or an electrical apparatus, such as a telephone set or an electric fan.

Figure 8:
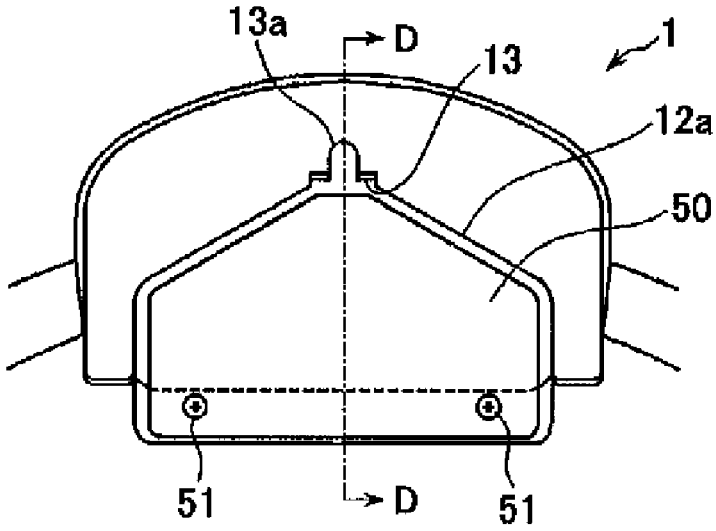
FIG. 8(*a*) is a front view showing a modification of the wall-mounted device, FIG. 8(*b*) is a cross-sectional view along line D-D in FIG. 8(*a*) as seen from arrows, and FIG. 8(*c*) is a partly enlarged cross-sectional view showing around a fixing screw in FIG. 8(*b*).
Figure 8:
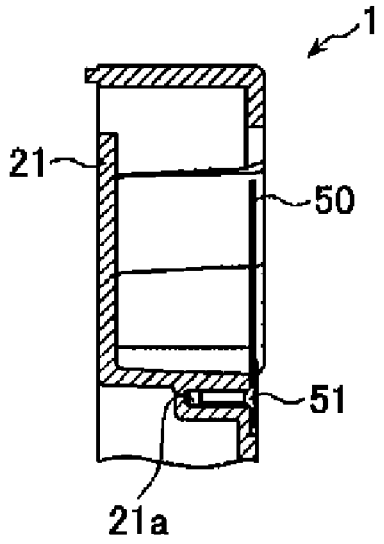
Figure 8:
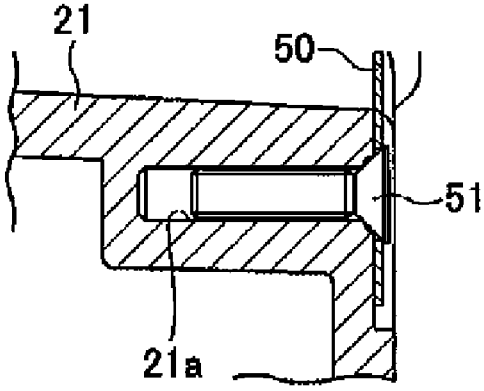

In addition, the foregoing description of the embodiment has been given of the example where the elastic plate member 10 has the first bent part 10*a* formed thereat. However, an elastic member 50 formed by a simple flat plate may be used as shown in FIG. 8. The elastic member 50 has its lower portion fixed to the casing 21 as fixing screws 51 are screwed into screw holes 21*a* formed in the casing 21.

A hole may be bored in an end of the elastic plate member 10 in the embodiment, and a wire or TY-RAP or the like may be put through the hole to achieve double effects of fall-off prevention and dismount prevention.

Figure 9:
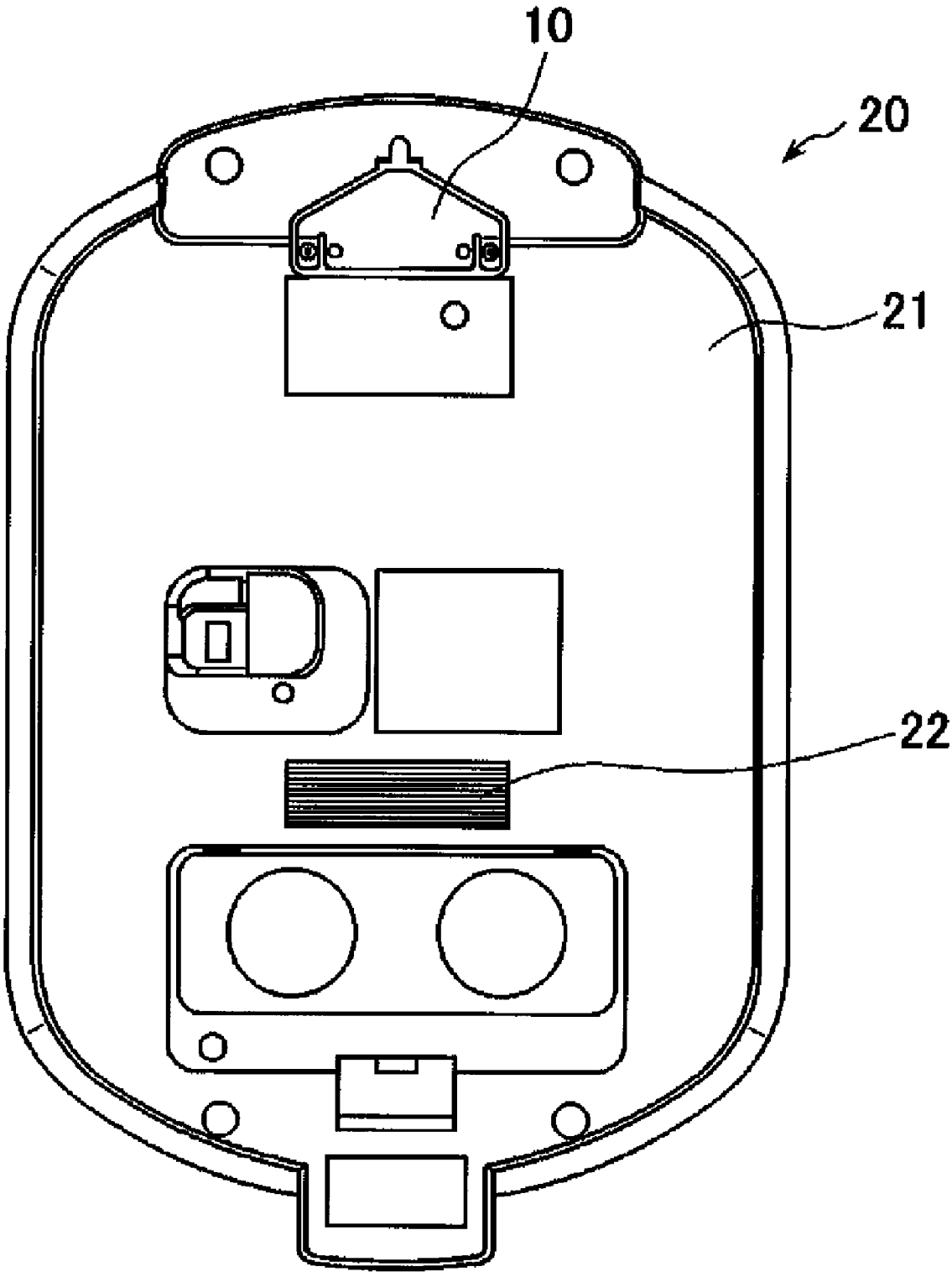
FIG. 9 is a front view showing the structure of a wall-mounted timepiece provided with an attaching/detaching member.

As shown in FIG. 9, an attachable/detachable attaching/detaching member, such as a surface fastener (MAGIC TAPE (registered trademark)) 22, may be adhered to the casing 21 and a wall surface or a pillar surface which faces and abuts on the casing 21.

This can prevent a change in posture when light vibration is applied to a to-be-mounted-on-wall object, without affecting the mounting or dismounting. As the present invention can surely mount a to-be-mounted-on-wall object, the invention can take such a structure.

This application is based on Japanese Patent Application No. 2006-114351 filed on Apr. 18, 2006, and the specification, claims, and drawings thereof are incorporated herein by reference in its entirety.

INDUSTRIAL APPLICABILITY

The present invention can be adopted to a device which mounts a to-be-mounted-on-wall object, such as a wall-mounted timepiece or a frame, on a wall surface or a pillar surface.

The invention claimed is:

1. A wall-mounted device (1) formed at a back side of a to-be-mounted-on-wall object for mounting the to-be-mounted-on-wall object on a wall surface or a pillar surface, comprising:

a recessed part (12) formed at the back side of the to-be-mounted-on-wall object;

a hanging part (13) which is formed of a plate-like element covering a first part of the recessed part (12) in a casing (21) of the wall mounted device (1) on which a fixture (30) fixed on the wall surface or the pillar surface is to be hung; and an elastic member (10) which has a plate member covering a second part of the recessed part (12) which does not overlap with the first part in such a manner that one end of the plate member opposed to the hanging part (13) is a free end and other end of the plate member is a fixed end, and in which an end face of the free end holds the fixture (30) by a force in an in-plane direction of the plate member, and the elastic member (10) on a side of the free end bends into the recessed part (12) when pressed in an out-of-plane direction, wherein the plate member of the elastic member (10) is disposed in a common plane as the casing (21) defining the hanging part (13) in such a manner that the free end of the elastic member (10) is opposed to the hanging part (13) defined in the recessed part (12) by the casing (21), and a gap for sandwiching the fixture (30) is formed in the common plane between the free end of the elastic member (10) and the hanging part (13) defined in the recessed part (12) by the casing (21) to which the free end is opposed.

2. The wall-mounted device (1) according to claim 1, wherein the elastic member (10) has a first bent part (10*a*) at the free end.

3. The wall-mounted device (1) according to claim 2, wherein the fixture (30) has a hook part (30*a*) which is arranged in abutment with the first bent part (10*a*).

4. The wall-mounted device (1) according to claim 1, wherein the elastic member (10) is formed so as to generate a sound when bent and/or returning from a bent state.

5. The wall-mounted device (1) according to claim 1, wherein the second part of the recessed part (12) has a linearly tapered shape toward the hanging part (13) as viewed in a plane view.

6. The wall-mounted device (1) according to claim 5, wherein the elastic member (10) has a shape corresponding to a shape of the recessed part (12).

7. The wall-mounted device (1) according to claim 1, wherein the elastic member (10) has a second bent part (10*b*) with an L-shaped cross section, and is bent with the second bent part (10*b*) being a fulcrum when the elastic member (10) is pressed toward an out-of-plane direction thereof.

8. The wall-mounted device (1) according to claim 1, wherein the elastic member (10) abuts on a bottom surface of the recessed part (12) when pressed and bent to a predetermined deformation.

9. The wall-mounted device (1) according to claim 1, wherein an attaching/detaching member (22) which is attachable and detachable to and from the wall surface or pillar surface facing the back side of the to-be-mounted-on-wall object is provided at the back side of the to-be-mounted-on-wall object.

10. A timepiece (20) having a wall-mounted device (1) as set forth in claim 1.

* * * * *